US011530885B2

(12) United States Patent
Verstraeten

(10) Patent No.: US 11,530,885 B2
(45) Date of Patent: Dec. 20, 2022

(54) DEVICE FOR DRIVING A FLEXIBLE LANCE

(71) Applicant: PEINEMANN EQUIPMENT B.V., Hoogvliet (NL)

(72) Inventor: Paul Verstraeten, Hoogvliet (NL)

(73) Assignee: PEINEMANN EQUIPMENT B.V., Hoogvliet (NL)

( * ) Notice: Subject to any disclaimer, the term of this patent is extended or adjusted under 35 U.S.C. 154(b) by 328 days.

(21) Appl. No.: 16/607,776

(22) PCT Filed: May 2, 2018

(86) PCT No.: PCT/NL2018/050288
§ 371 (c)(1),
(2) Date: Oct. 24, 2019

(87) PCT Pub. No.: WO2018/203747
PCT Pub. Date: Nov. 8, 2018

(65) Prior Publication Data

US 2020/0191507 A1 Jun. 18, 2020

(30) Foreign Application Priority Data

May 5, 2017 (NL) ..... 2018861

(51) Int. Cl.
*F28G 15/04* (2006.01)
*B08B 9/043* (2006.01)
(Continued)

(52) U.S. Cl.
CPC ..... *F28G 15/04* (2013.01); *B08B 9/0433* (2013.01); *B08B 9/043* (2013.01); *B08B 9/045* (2013.01);
(Continued)

(58) Field of Classification Search
CPC ..... B08B 9/0433; B08B 9/043; B08B 9/045; B08B 2209/04; B08B 9/0436; F28G 1/00; F28G 15/04; F28G 1/163; F28G 15/02
See application file for complete search history.

(56) References Cited

U.S. PATENT DOCUMENTS 3,354,490 A 11/1967 Masters et al.
3,632,100 A * 1/1972 Schneider ..... C21B 7/24 266/99
(Continued)

FOREIGN PATENT DOCUMENTS

CN 204999397 U 1/2016
FR 2955651 A1 7/2011
(Continued)

OTHER PUBLICATIONS

International Preliminary Report on Patentability for the International Patent Application No. PCT/NL2018/050288, dated Nov. 14, 2019, 7 pages.
(Continued)

*Primary Examiner* — Benjamin L Osterhout
(74) *Attorney, Agent, or Firm* — KDB Firm PLLC

(57) ABSTRACT

A device for driving a flexible lance for cleaning a heat exchanger duct or the like, includes a frame in which a driving mechanism is arranged for moving this flexible lance in a driving direction in the direction of an outlet opening. The driving mechanism is provided with a clamp member which can be clamped on the flexible lance and which is movable in the frame towards and away from this outlet opening. The clamp member is mounted on an endless drive element. The active part of the endless drive runs parallel to the driving direction. The drive mechanism further comprises at least one non-driven counter roller arranged oppo-
(Continued)

site said clamp member. The lance is clamped between the clamp member and the counter roller.

19 Claims, 8 Drawing Sheets

(51) Int. Cl.

| | |
|---|---|
| *B08B 9/045* | (2006.01) |
| *F28G 1/16* | (2006.01) |
| *F28G 15/02* | (2006.01) |
| *F28G 1/00* | (2006.01) |

(52) U.S. Cl.
CPC ..... *B08B 9/0436* (2013.01); *B08B 2209/04* (2013.01); *F28G 1/00* (2013.01); *F28G 1/163* (2013.01); *F28G 15/02* (2013.01)

(56) References Cited

U.S. PATENT DOCUMENTS 5,002,120 A * 3/1991 Boisture ..... B65H 75/4402 122/391
5,067,558 A * 11/1991 Boisture ..... F28G 15/04 165/95
5,184,636 A * 2/1993 van der Woude ..... F28G 15/04 134/167 C
5,494,235 A * 2/1996 Vowles ..... B65H 75/42 242/390.3
5,560,323 A * 10/1996 Billings ..... F28G 3/16 122/379
6,681,839 B1 * 1/2004 Balzer ..... F28G 1/163 122/379
6,757,932 B1 * 7/2004 Verstraeten ..... B08B 9/043 15/315
2009/0255557 A1 * 10/2009 Gardner ..... B08B 9/0433 134/18
2010/0300498 A1 12/2010 Wojciechowski et al.
2012/0067370 A1 * 3/2012 Crock ..... F28G 3/163 134/6
2013/0220389 A1 * 8/2013 Snow ..... B08B 3/02 134/166 C
2015/0068563 A1 * 3/2015 Gzym ..... F28G 15/003 134/168 C
2016/0023264 A1 * 1/2016 Barnes ..... B65H 51/10 226/152
2016/0025432 A1 * 1/2016 Mathis ..... F16L 3/223 248/68.1
2016/0025433 A1 * 1/2016 Mathis ..... F28G 3/163 269/1
2016/0052029 A1 2/2016 Moll et al.
2016/0096202 A1 * 4/2016 Zink ..... F28G 1/163 134/179
2016/0209135 A1 * 7/2016 Moring ..... F28G 15/02
2017/0102195 A1 * 4/2017 Watkins ..... F28G 1/04
2017/0108300 A1 * 4/2017 Brumfield ..... F28G 15/02
2017/0321976 A1 * 11/2017 Barnes ..... F28G 15/04
2018/0161833 A1 * 6/2018 Zink ..... B08B 9/0433
2018/0266777 A1 * 9/2018 Krauser ..... F28G 15/02
2020/0191507 A1 6/2020 Verstraeten

FOREIGN PATENT DOCUMENTS

GB 2320076 A 6/1998
JP S505995 U 1/1975
WO 0111303 A1 2/2001

OTHER PUBLICATIONS

International Search Report and Written Opinion for the International Patent Application No. PCT/NL2018/050288, dated Aug. 2, 2018, 10 pages.

* cited by examiner

DEVICE FOR DRIVING A FLEXIBLE LANCE

This is a national stage application filed under 35 U.S.C. § 371 of pending international application PCT/NL2018/050288 filed May 2, 2018, which claims priority to Netherlands Patent application NL 2018861, filed May 5, 2017, the entirety of which applications are hereby incorporated by reference herein.

The present invention relates to a device for driving a flexible lance. A flexible lance is used to clean the ducts in a heat exchanger. In the course of time these ducts become fouled such that the through-flow is blocked to a greater or lesser degree. In order to enable the heat exchanger to function optimally again the ducts, particularly the pipes thereof, are cleaned by injecting liquid under high pressure through these ducts using a high-pressure lance.

For instance from WO01/11303A1, a device for driving a flexible lance for cleaning a heat exchanger duct or the like is known, which device is provided with a frame in which a means driving a flexible lance is arranged for moving this flexible lance in the direction of an outlet opening. According to thus publication, the driving means is provided with a member which can be clamped around the flexible lance and which is movable in the frame towards and away from this outlet opening, said clamping member being formed by two parts which can be pressed against each other, each of which is mounted on an endless drive element, wherein the active parts of the two endless drive elements run parallel to each other.

It is an object, amongst other objects, of the present invention to provide an improved, compact and/or efficient device for driving a flexible lance.

This object, amongst other objects, is achieved with the device according to claim 1. More specifically, this object, amongst other objects, is achieved with a device for driving a flexible lance for cleaning a heat exchanger duct or the like, provided with a frame in which a driving mechanism is arranged for moving this flexible lance in a driving direction in the direction of an outlet opening, wherein the driving mechanism is provided with a clamp member which can be clamped on the flexible lance and which is movable in the frame towards and away from this outlet opening, wherein said clamp member is mounted on an endless drive element, wherein the active part of the endless drive runs parallel to the driving direction, wherein the drive mechanism further comprises at least one non-driven counter roller arranged opposite said clamp member, wherein the lance is clamped between the clamp member and the counter roller.

By providing a clamp member provided on an endless drive element, such as a driving belt or driving chain, on one side of the lance to be driven and a non-driven counter roller at the other side, such that the lance is firmly clamped there between, a compact and efficient device is obtained. Although the driving of a lance requires substantial force, in particular in the case of a clogged duct due to fouling, it was found that by providing a driven clamp member at one side and a non-driven counter roller on the other side, a lance can still be driven efficiently and reliably. Preferably, the non-driven counter roll is arranged bearing mounted in the frame and is arranged to rotate due to the movement of the lance as driven by the clamp member. A rotation axis of the counter roller hereto preferably extends perpendicular to the driving direction.

The traction between the lance and the clamping member is improved if according to a preferred embodiment, the counter roller is biased in a direction towards the clamp element for clamping the lance there between. The counter roller is hereby urged towards the lance to be driven, thereby forcing the lance towards the clamp member. The counter roller is hereby preferably movable in a direction perpendicular to the driving direction and perpendicular to the rotation axis.

A further improved driving of the lance in terms of stability is obtained if according to a further preferred embodiment, the driving mechanism is provided with a plurality of counter rollers, wherein the rotation axes of said counter rollers substantially extend in a plane parallel to said driving direction. The plurality of counter rollers are hereby arranged to engage the lance at a plurality of locations along the length of the lance, thereby stabilizing the lance and therewith improving the driving of the lance with the clamp member. Preferably, all counter rollers are non-driven, although it is envisaged that at least one of the counter rollers from the plurality of counter rollers is non-driven. At least one of the counter-rollers is then non-driven.

According to a further preferred embodiment, the plurality of rollers is arranged on a separate counter roller frame mounted in the frame, wherein the counter roller frame is movable with respect to said frame, wherein the counter roller frame is biased in the frame. An efficient configuration is thus obtained which allows movement of the counter rollers towards the clamp member for increasing the traction. Further, by providing a separate counter roller frame, which is preferably removable from the frame, the driving mechanism, and in particular the clamp member thereof, can be made accessible efficiently, for instance for maintenance.

Preferably, the counter roller frame is suspended in the frame and biased towards the clamp member, for instance by using a spring member, which may be arranged between the frame and the counter roller frame for biasing the counter rollers towards the clamp member as mentioned above.

To compensate for any irregularities in the lance, it is preferred if at least two of the counter rollers are movable with respect to each other in a direction towards and away from the lance to be driven. Proper contact with the clamping element is thus ensured. Preferably, the counter rollers are movable in a direction, or at least in a direction having a component, perpendicular to the driving direction and to the rotation axes, i.e. perpendicular to the plane as defined above.

One or more of the counter rollers may be arranged independently movable in the frame. As an example, the rotation axis of a counter roller, for instance the ends thereof, may be arranged in a slot, thereby allowing movement of the roller along the slot. Other guiding means or guides are envisaged.

An efficient relative movement is obtained if, according to a further preferred embodiment, at least two counter rollers are arranged on a subframe, wherein the subframe is arranged pivotally allowing relative movement of the counter rollers. The subframe is preferably pivotally arranged in the device, for instance in the frame, having a pivot axis extending between the rotation axes of the two counter rollers on the frame, wherein said pivot axis is preferably substantially parallel to said rotations axes. This ensures that if the one counter roller moves away from the lance due to for instance an irregularity, the other counter roller on the subframe is pivoted towards the lance, thereby ensuring in a firm clamping action.

To further improve the compensation for any irregularities in the lance, it is preferred if the counter rollers are mounted in a set of connected sub frames, wherein a minor subframe is arranged pivotally in a major subframe, thereby allowing relative movement between the minor sub frames, wherein relative movement of the counter rollers is allowed. The frames may be arranged to form a whippletree mechanism, that is preferably pivotally connected to the frame or the counter roller frame. The counter rollers are hereby movable in a direction perpendicular to the driving direction an to the rotation axis, while ensuring a substantially even distribution of the urging load onto the lance to be driven and firm contact with the clamping element. Other mechanisms for distributing the urging load substantially evenly over the counter rollers are envisaged.

According to a preferred embodiment of the invention, the subframe is pivotally arranged in the counter roller frame, which is preferably biased in the (main) frame. The biased counter roller frame is hereby urged, i.e. biased, towards the clamp member for ensuring good traction, while the subframe, preferably a plurality thereof, compensates for any irregularities.

An improved driving is obtained if, according to a further preferred embodiment, the endless drive element comprises a plurality of clamp members arranged along the length thereof. The clamp members are preferably separate from each other. Any liquid present on the lance can then be discharged efficiently, which prevents slippage and thus improves driving the range. To this end, at least the surfaces of the clamp members engaging the lance are formed separately. In this way a broken engaging surface for the clamp members is obtained.

Preferably, the clamp members are arranged to pivotally connect to the endless drive element, or are at least arranged to pivot with respect to driving direction along which the lance is driven. The pivoting clamp members improve the traction.

In particular at the ends of the active parts, i.e. at the beginning of the turn towards the return path opposite the active part of the endless drive element, or the end of the turn towards the active path, the clamp members will pivot with respect to the lance, improving the traction there. A line contact is created between the clamp member and the lance at this location. To also allow pivoting movement of clamp members in the active part, it is preferred if the clamp members are arranged at mutual distances on the endless drive element along the length thereof. Also along the active parts, the clamp members are allowed to pivot to improve the traction. The distance between the clamp members is then preferably sufficient to allow a pivot movement to improve the clamping, for instance an angle of at least 5°, more preferably at least 10°. The distance between two clamp members is then at least half the height of a clamp member.

Due to the driving force provided by the endless drive element at the driven end of the clamp members and the reaction force of the lance at the contact end of the clamp members, the members are urged to pivot backwards with respect to the driving direction. Thereby a high pressure contact area between the lance and the clamp member is obtained, which further improves the traction between the clamp member and the lance To ensure good traction in particular at the pivoting locations of the clamp members, according to a further preferred a counter roller is at least located near the end of the active part of the endless drive element. At the end of the active path the clamping members starts to pivot towards the return path. By providing a counter roller at this pivoting point, the lance is urged towards the pivoted clamp member, thereby forming a high pressure contact area and obtaining an optimal traction between the clamp member and the lance. Preferably counter rollers are located at least at both ends of the active parts of the endless drive element. Thereby high pressure contact areas, and thus an optimal traction, between the clamp members at both ends of the active path and the lance are obtained.

To improve the traction between the clamp member and the lance to be driven, it is preferred if a clamp member comprises a base member arranged to connect to the endless drive element, wherein the base member holds a plastic, or rubber, engaging member. The base member hereby provides rigidity, while the plastic material improves the traction. A suitable material is for instance polyurethane. As an alternative, the engaging member, or the clamping member as a whole, is formed from metal, such as aluminum or (stainless) steel.

A firm interconnection between the base member and the engaging member is obtained if the base member is substantially U-shaped, wherein the engaging member is received between the legs of the U-shape. The lance is then to be received by the engaging member retained in the U-shape. Any outward bending of the engaging member, which may thus be formed of a softer material allowing a higher traction, is then prevented. The outer ends of the legs may be bent inwardly to hold the engaging member.

The driving is further improved if the clamp member, preferably the engaging member thereof, is provided with a engaging surface at least partially formed complementary to the lance to be engaged. Preferably, the engaging member is provided with a V-shaped slot. Lances of different diameters can then be efficiently received and driven in the slot. A reliable drive is obtained if the counter roller is arranged to substantially engage the engaging surface of the clamp member if no lance is supplied to the drive system, such that the distance between the axis of the counter roller and upper end of the clamp member on the active path, which is in contact with the counter roller, is equal or less then the radius of the counter roller. Thereby, even for small diameter lances, effective contacts between the lance and counter roller and the lance and the clamp members are obtained, such that these can be driven effectively.

The combination of the counter rollers and the clamp members is found to result in a very efficient driving of the lance. As said, this allows providing a driven element at only one side of the lance. As an alternative however, the pivoting clamp members may also be used in combination with another drive mechanism than the non-driven counter rollers as described. For instance, one of the rollers may be driven or a endless drive member, for instance also provided with pivoting clamp members, may be provided at the other side.

The invention further relates to an endless drive element provided with clamp members for use in device according to the invention.

The present invention is further illustrated by the following Figures, which show a preferred embodiment of the device according to the invention, and are not intended to limit the scope of the invention in any way, wherein.

Figure 1:
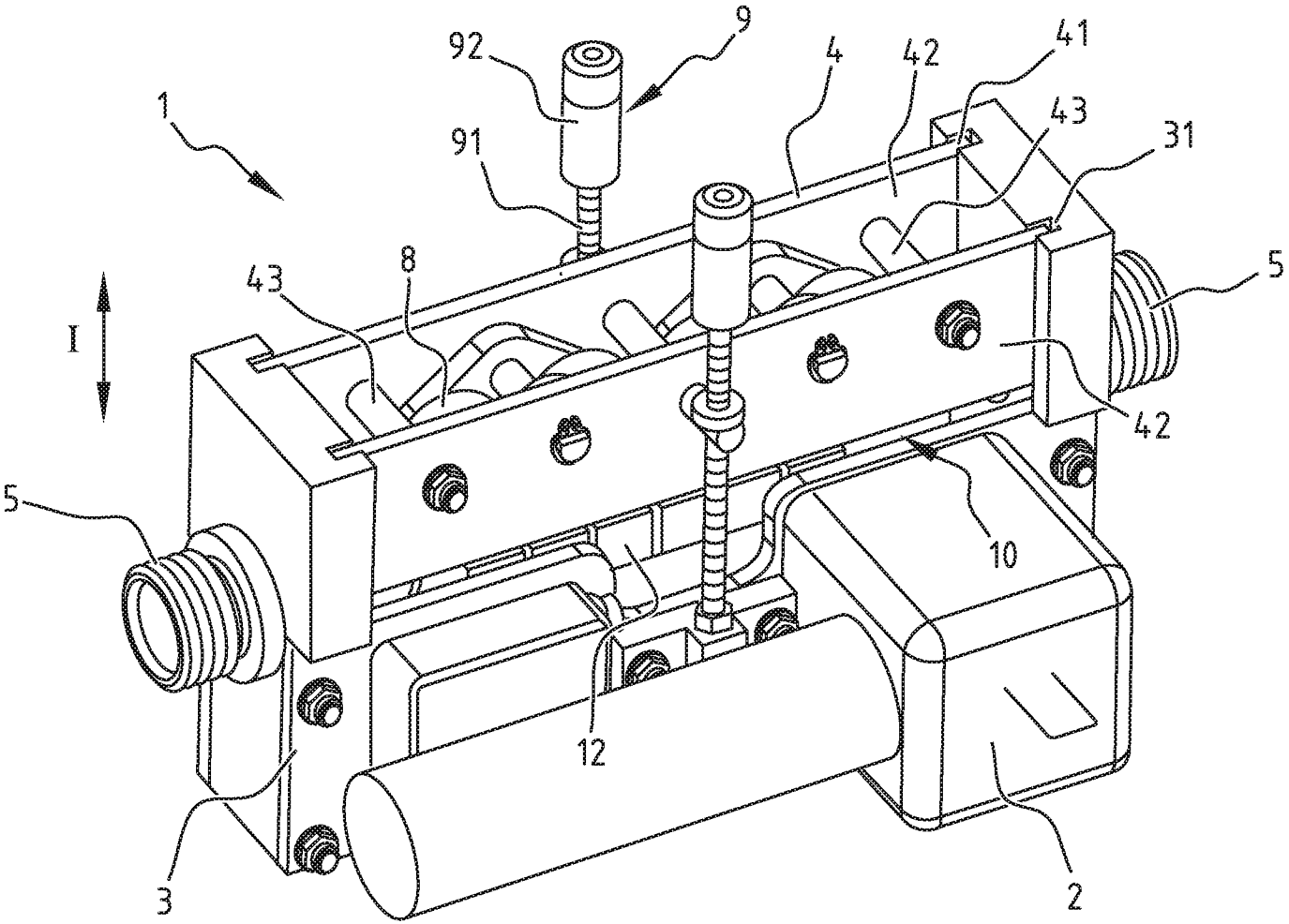
FIG. 1 is a perspective view of the device according to a preferred embodiment.

FIG. 1 shows a driving device 1 for flexible lances according to the invention. The device comprises in- and outlets 5 for the flexible lance 11, see also FIG. 3. The lance 11 is to be driven in the direction between the in- and outlets 5. The driving device 1 comprises a driving unit 2, in particular a pneumatic motor, for driving the device 1, which is mounted to a frame 3. The frame 3 supports a counter-roller frame 4 and the counter roller frame 4 supports a plurality of counter rollers 8 which are arranged to roll on, preferably non-driven, on the lance 11. Opposite the counter rollers 8 is an endless drive element in the form of a chain 13 which is provided with a plurality of clamp members 12. The driving unit 2 drives the chain 13, thereby driving a lance 11 held between the clamp members 12 on the chain 13 and the counter rollers 8.

The counter roller frame 4 basically comprises two plate members 42 interconnected by a beam or bolt 43. The ends 41 of the plates 42 are received in slots 31. The counter roller frame 4 is thus movable with respect to the frame 3 in the vertical direction, indicated with I in the figures. In this vertical direction, the counter roller frame 4, and therewith the counter rollers 8, is urged towards the clamp members the frame 3, more specifically towards the clamp members 12 supported therein. An urging system 9 is hereto provided, which is in this embodiment formed by a nut-like element 92 on a treaded rod 91 and a compressed elastic element (not shown).

Figure 2:
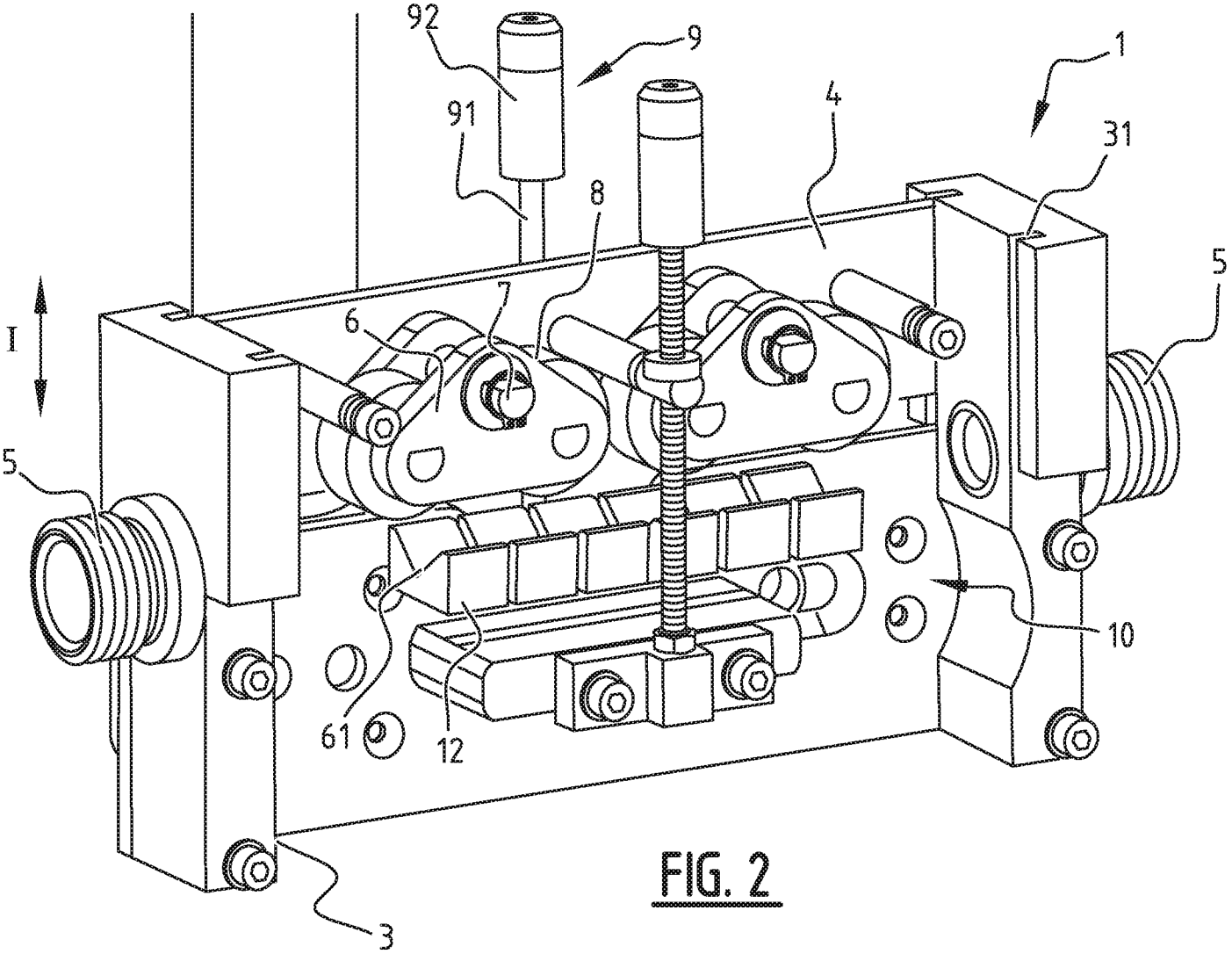
FIG. 2 is a partly broken away perspective view of the same device as in FIG. 1.

In FIG. 2 the driving device 1 is shown in a partly broken away perspective view, thereby showing the counter roller frame 4 in greater detail, which preferably comprises at least one subframe 6, which is connected to the counter roller frame 4 through the subframe pivot axis 7. The counter rollers 9 are hereby movable with respect to each other in in a direction having a component in the direction indicated with I.

Figure 3:
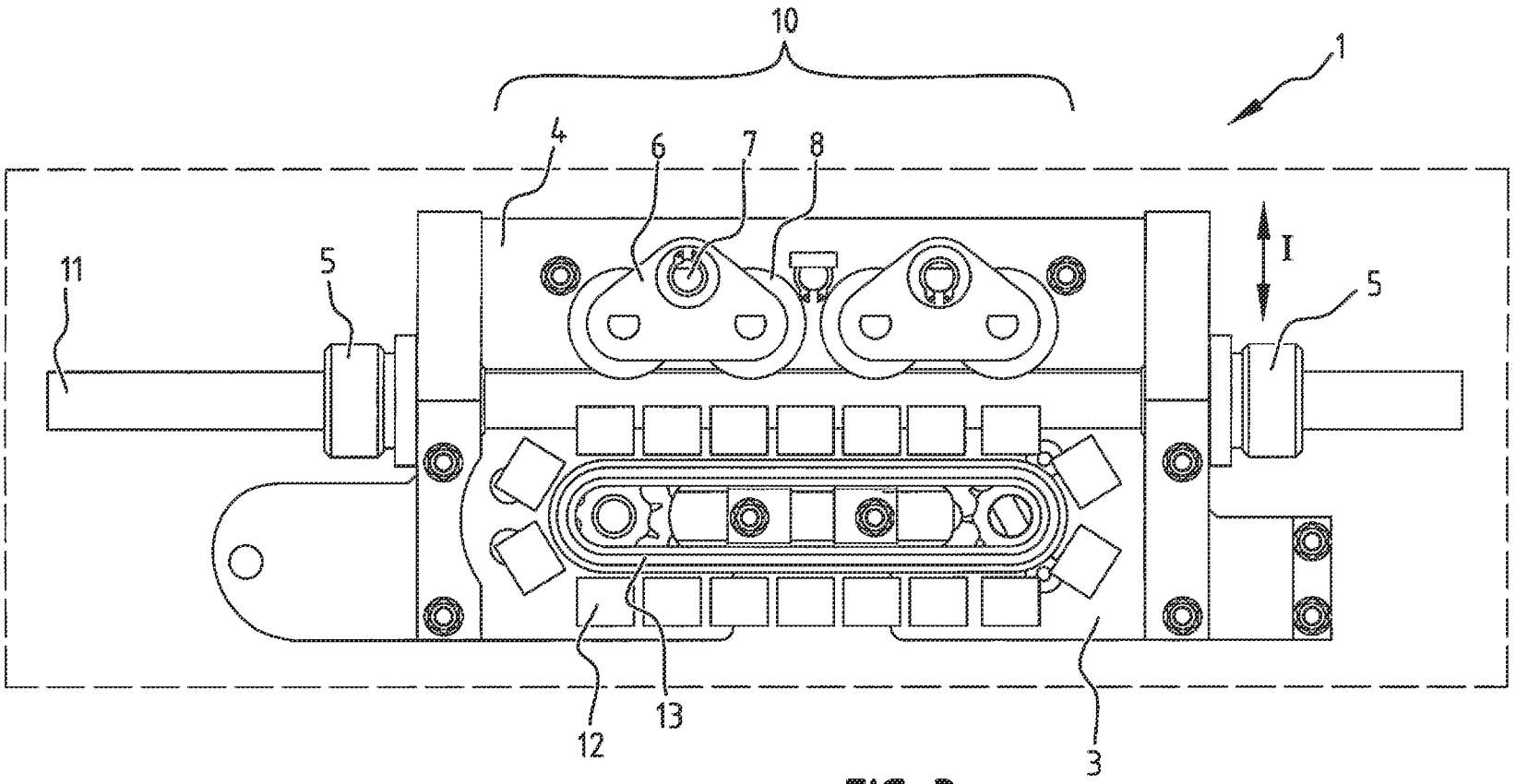
FIG. 3 is a schematic view of the same device as shown in FIG. 1.
Figure 4:
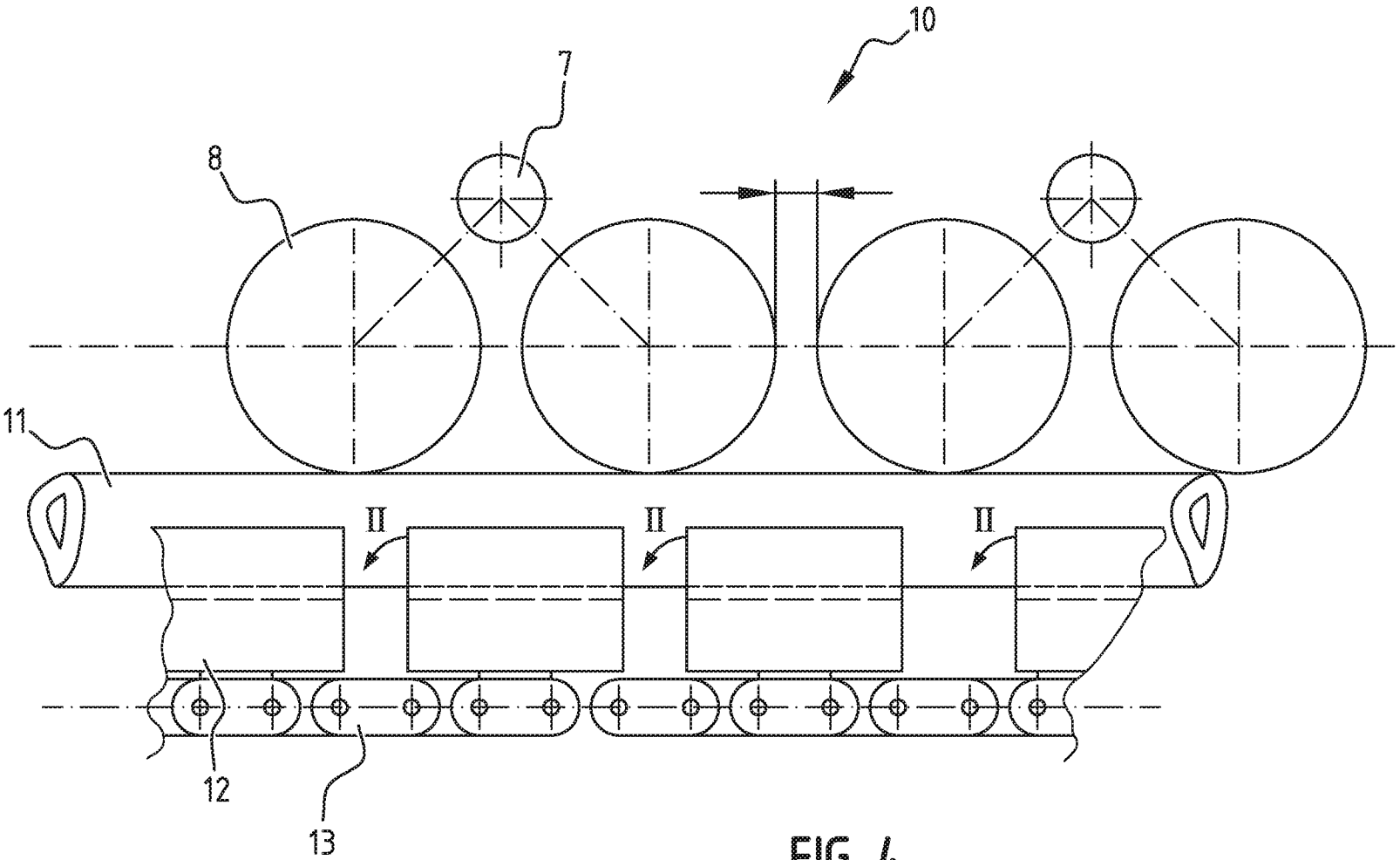
FIG. 4 shows schematically a part of the drive system of the device in the plane parallel to the driving direction.

In FIGS. 3 and 4 a schematic view of the driving system 10, including a flexible lance 11, is shown. As said, the driving system 10 comprises counter rollers 8, the clamp members 12 and an endless drive element 13 onto which the clamp members 12 are arranged. The counter rollers 8, which are urged onto the flexible lance 11 by the urging systems 9, ensure a good traction between the flexible lance 11 and the clamp members 12.

Figure 5A:
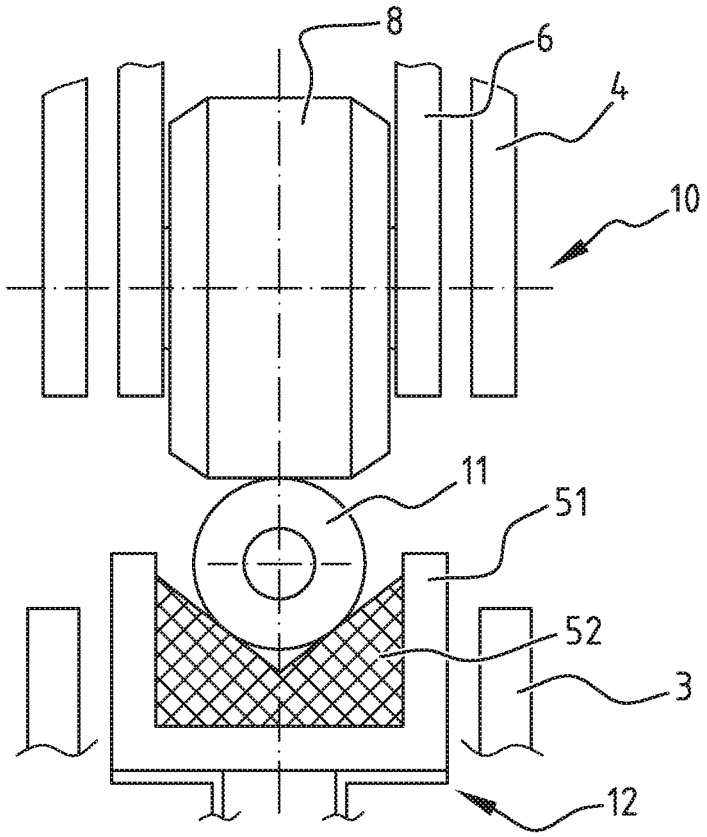
FIG. 5 shows schematically a part of the drive system of the device in the plane perpendicular to the driving direction.
Figure 5B:
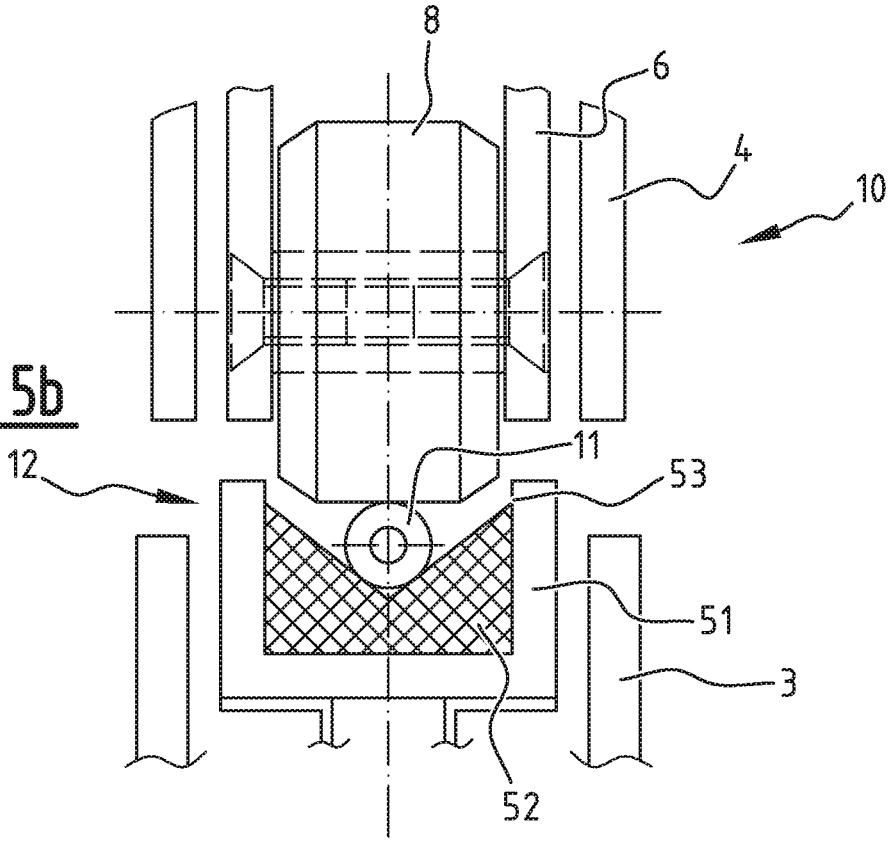

In FIGS. 5A and 5B the drive system 10 is shown in a plane perpendicular to the driving direction. The clamp members 12, which are formed in this embodiment from a base member 51 and a V-shaped engagement member 52, are suited for engaging flexible lances 11 of different diameters. In addition, the width of the counter rollers 8 is such that the counter rollers 8 are suited to engage the engagement members 52 when no flexible lance 11 is provided, while not engaging the inner surfaces 53 of the side walls of the base members 51. The width of the counter rollers 8 is thus smaller than the distance between the legs of U-shaped base member 3.

Figure 6:
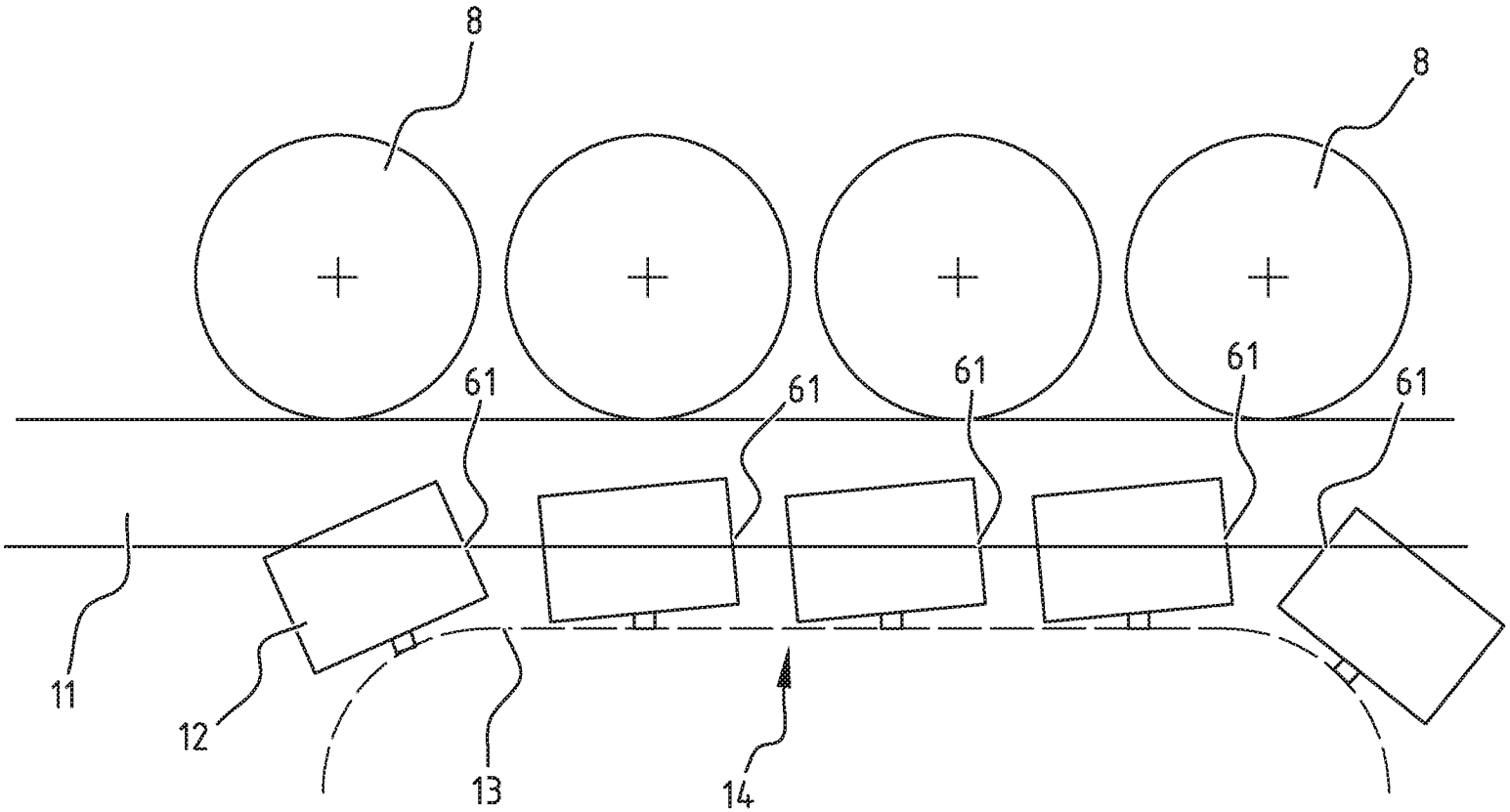
FIG. 6 shows further details of the active part of the endless drive element in operation in the plane parallel to the driving direction.

With reference to for instance FIG. 4, it can be seen that the clamp members 12 are arranged at mutual distances with respect to each other. The lance 11 is thus engaged intermittently, i.e. not along a surface along its length. This distances further allow pivoting of the clamp members 12 with respect to the surface of the lance 11 to be driven, indicated with the arrows II in FIG. 4. This pivoted or tilted configuration of the clamp members 12 is shown schematically in FIG. 6, which shows the active part 14 of the endless drive element 13. The forces exerted on the clamp members 12, at the lower end of the clamp members 12 by the endless drive element 13 and at the upper end of the clamp members 12 by the flexible lance 11, tilt the clamp members 12 around the axis parallel to the rotation axis of the counter rollers 8. Due to this tilting, areas of high contact pressure 61 are formed on the engagement surfaces of the tilted clamp members 12. Reference is also made to FIG. 2, wherein for one clamp member 12 this contact point(s) or contact line 61 is indicated. In this embodiment, counter rollers 8 are at least located near the end of the active part 14 of the endless drive element, thereby areas of high contact pressure 61 are formed on the clamp members 12 at both ends of the active part 14 of the endless drive element 13.

Figure 7:
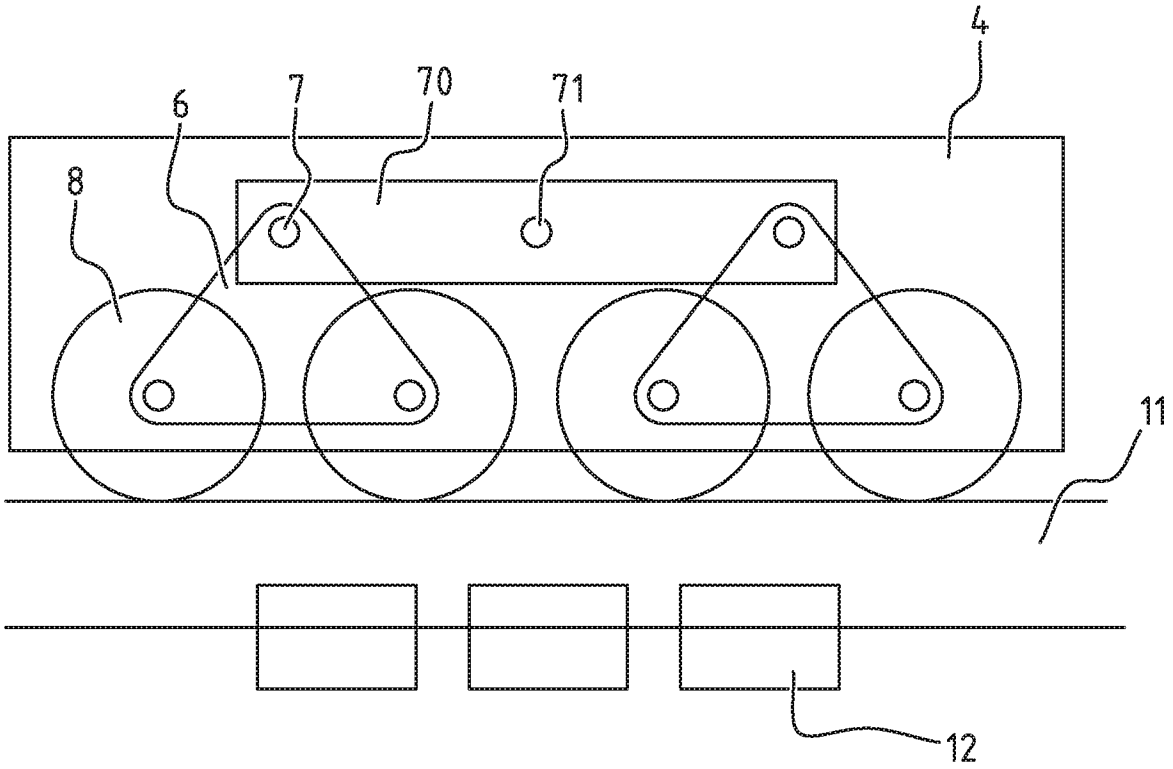
FIGS. 7 and 8 show other examples of counter roller frame configurations.

A second embodiment of the counter roller frame 4 is shown in FIG. 7. In this embodiment the sub frames 6 comprising the counter rollers 8, are connected to a major subframe 70 through the subframe pivot axes 7. The major subframe 70 is connected to the counter roller frame 4 through the major subframe pivot axis 71, thereby forming a wippletree mechanism. The construction of the counter roller frame 4 according to this second embodiment ensures a more evenly distribution of the urging load to the flexible lance 11 and the clamp members 12, thereby resulting in a better traction between the flexible lance 11 and the clamp members 12.

Figure 8A:
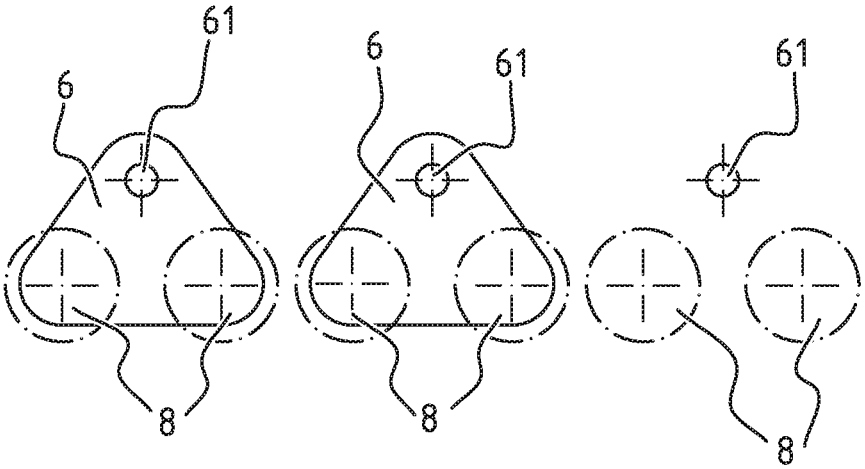
Figure 8B:
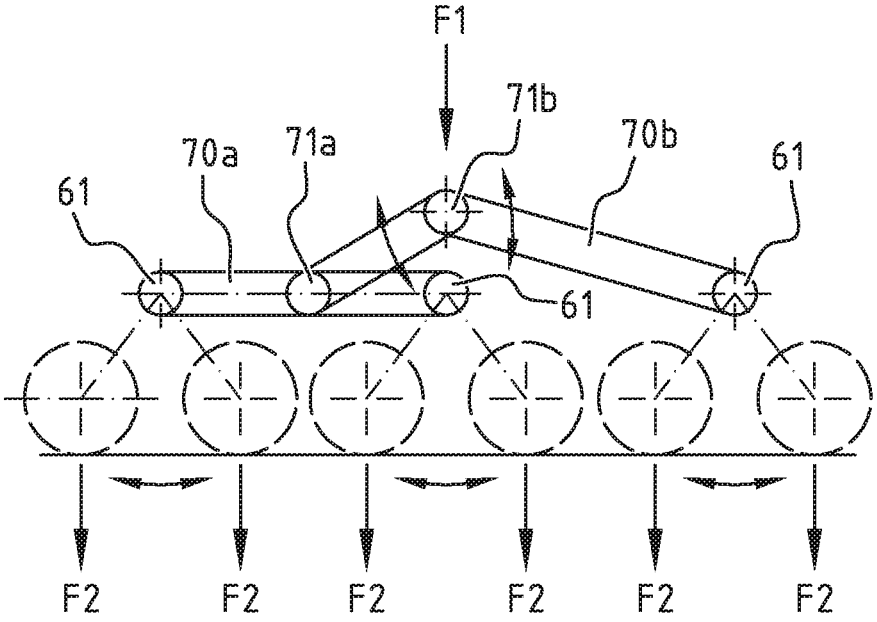

FIG. 8 shows another variant of the counter roller frame in different parts. Counter rollers 8 are provided, preferably in sets of two, at mutual distances on subframes 6, which have a triangular shape in this example. The lower corners receive the axes of two counter rollers 8, the top corner is provided with a pivot axis 61 connecting the sub frame pivotally to a frame 70*a*, 70*b*. Frame 70*a* carries two subframes 6, major sub frame 70*a* caries one sub frame 6 at one, each sub frame at a pivot axis 71, end and the minor frame 70*a* at the other end at pivot axis 71*a*. It may be possible that another minor frame 70*a* is connected to the other end of the major axis 70*b*. Provided at a central location between the counter rollers 8, is a central pivot axis 71*b* with which the system as shown is connected to the frame 4. The system is arranged such that a force F1 exerted on axis 71*b* is distributed evenly over the counter rollers 8, indicated with the arrows F2.

In this example, the pivot axes 61 of the subframes 6 are arranged at equal distances. The frames 70*a, b* are shaped such that an even load can be applied by the counter rollers 8. The central pivot axis 71*b* is preferably also arranged accordingly to this end.

The present invention is not limited to the embodiment shown, but extends also to other embodiments falling within the scope of the appended claims.

The invention claimed is:

1. A device for driving a flexible lance for cleaning a heat exchanger duct, comprising:

a frame, a driving mechanism coupled to said frame, the driving mechanism configured for moving the flexible lance in a driving direction which is in a direction of an outlet opening, wherein the driving mechanism includes a clamp member which is clampable on the flexible lance and which is linearly movable in the frame towards and away from the outlet opening, wherein said clamp member is mounted on and moves with an endless drive element, wherein the endless drive element includes an active part that runs parallel to the driving direction, wherein the driving mechanism further comprises at least one non-driven counter roller arranged opposite said clamp member, and wherein the flexible lance is clampable between the clamp member and the non-driven counter roller.

2. The device for driving a flexible lance according to claim 1, wherein the non-driven counter roller is biased in a direction towards the clamp member for clamping the flexible lance there between.

3. The device for driving a flexible lance according to claim 1, wherein the driving mechanism is provided with a plurality of counter rollers, wherein the rotation axes of said counter rollers substantially extend in a plane parallel to said driving direction.

4. The device according to claim 3, wherein the plurality of counter rollers is arranged on a separate counter roller frame mounted in the frame, wherein the counter roller frame is movable with respect to said frame, and wherein the counter roller frame is biased in the frame.

5. The device for driving a flexible lance according to claim 3, wherein at least two of the counter rollers are movable with respect to each other in a direction towards and away from the flexible lance to be driven.

6. The device for driving a flexible lance according to claim 5, wherein at least two counter rollers are arranged on a subframe, wherein the subframe is arranged for pivotally allowing relative movement of the counter rollers.

7. The device for driving a flexible lance according to claim 6, wherein the plurality of counter rollers is arranged on a separate counter roller frame mounted in the frame, and wherein the subframe is pivotally arranged in the counter roller frame.

8. The device for driving a flexible lance according to claim 1, wherein the endless drive element comprises a plurality of separate clamp members arranged along the length thereof.

9. The device for driving a flexible lance according to claim 8, wherein the clamp members are arranged to pivotally connect to the endless drive element.

10. The device for driving a flexible lance according to claim 9, wherein the clamp members are arranged at mutual distances on the endless drive element along the length thereof.

11. The device for driving a flexible lance according to claim 9, wherein a counter roller is located adjacent an end of the active part of the endless drive element.

12. The device for driving a flexible lance according to claim 11, wherein counter rollers are located at both ends of a plurality of said active parts of the endless drive element.

13. The device for driving a flexible lance according to claim 8, wherein one of said plurality of separate clamp members comprises a base member arranged to connect to the endless drive element, wherein the base member holds a plastic engaging member.

14. The device for driving a flexible lance according to claim 13, wherein the base member is substantially U-shaped, wherein the engaging member is received between the legs of the U-shape.

15. The device for driving a flexible lance according to claim 1, wherein the clamp member is provided with an engaging surface at least partially formed complementary to the lance to be engaged.

16. The device for driving a flexible lance according to claim 15, wherein the clamp member includes a V-shaped slot.

17. The device for driving a flexible lance according to claim 15, wherein the non-driven counter roller is arranged to substantially engage the engaging surface of the clamp member when the flexible lance is not disposed within the drive system, such that the distance between the axis of the non-driven counter roller and upper end of the clamp member on an active path, which is in contact with the non-driven counter roller, is equal or less then the radius of the non-driven counter roller.

18. A device for driving a flexible lance for cleaning a heat exchanger duct, comprising:

a frame, a driving mechanism coupled to said frame, the driving mechanism configured for moving the flexible lance in a driving direction in the direction of an outlet opening, wherein the driving mechanism comprises a plurality of separate clamp members which are clampable on the flexible lance and which are linearly movable in the frame towards and away from the outlet opening, the device further comprising an endless drive element, wherein the clamp members are mounted on the endless drive element and arranged along the length thereof, wherein an active part of the endless drive element runs parallel to the driving direction, wherein the driving mechanism further comprises a second drive mechanism arranged opposite said clamp members, wherein the flexible lance is clampable between the clamp members and the second drive mechanism, and wherein the clamp members are arranged to pivotally connect to and move with the endless drive element.

19. The device according to claim 18, wherein the distance between the clamp members is sufficient to allow a pivoting movement of the clamp members of at least 5°.

* * * * *